US006089783A

United States Patent [19]

Goacolou

[11] Patent Number: 6,089,783

[45] Date of Patent: Jul. 18, 2000

[54] THREE-LAYERED ROAD STRUCTURE

[75] Inventor: Honoré Goacolou, Les Clayes-sous-Bois, France

[73] Assignee: Entreprise Jean Lefebvre, France

[21] Appl. No.: 09/269,843

[22] PCT Filed: Oct. 2, 1997

[86] PCT No.: PCT/FR97/01740

§ 371 Date: Apr. 1, 1999

§ 102(e) Date: Apr. 1, 1999

[87] PCT Pub. No.: WO98/14663

PCT Pub. Date: Apr. 9, 1998

[30] Foreign Application Priority Data

Oct. 2, 1996 [FR] France ..... 96 12001

[51] Int. Cl.[7] ..... E01C 3/00

[52] U.S. Cl. ..... 404/27; 404/31

[58] Field of Search ..... 404/17, 27, 28, 404/30, 31, 82

[56] References Cited

U.S. PATENT DOCUMENTS 4,167,356 9/1979 Constantinescu ..... 404/31

4,708,516 11/1987 Miller ..... 404/31

FOREIGN PATENT DOCUMENTS 0 069015 A1 1/1983 European Pat. Off. .

WO 86/00351 1/1986 WIPO .

*Primary Examiner*—James A. Lisehora

*Attorney, Agent, or Firm*—Mason, Kolemainen, Rathburn & Wyss

[57] ABSTRACT

The invention concerns a novel road structure whose bearing part on top of the ground comprises three successive layers of bituminous material bonded with one another, namely: a base layer which rests on the ground with optional insertion of a forming layer of thickness $H_i$ such that: 4 cm$\leqq H_i \leqq$10 cm, and of elastic modulus: $E_i$; a median layer of thickness $H_m$ such that: 4 cm$\leqq H_m \leqq$20 cm, and of elastic modulus $E_m$ such that: 2000 MPa$<E_m<$8000 MPa; and a top layer of thickness $H_s$ such that: 4 cm$\leqq H_s \leqq$10 cm, and of elastic modulus $E_s$, such that elastic moduli of said layers comply with inequality relationships (a) and (b).

11 Claims, 15 Drawing Sheets hi = hs = 6 cm

Ei = Es = 17800 Mla

Es / Em = 1

Es / Em = 4

Es / Em = 35

INVERSE STRUCTURE,
BOTH LAYERS DAMAGED SIMULTANEOUSLY

MONOLITHIC STRUCTURE,
ONLY ONE LAYER DAMAGED

THREE-LAYERED ROAD STRUCTURE

BACKGROUND OF THE INVENTION

1. Field of the Invention

The present invention concerns a novel road structure in which the bearing portion on top of the ground comprises three successive layers of bituminous material bonded with one another.

2. Background of the Invention

Road structures have long been constructed using natural or crushed aggregates, but initially without incorporating binders to enhance their cohesion. Nowadays the two techniques, i.e. incorporating binders or not, are used independently or in a combined fashion.

With a technology of the above kind employing structures made from untreated materials, the main design rule is the progressive nature of the moduli of rigidity. The materials with the lowest performance form a base layer which rests on the ground, with optional insertion of a forming layer; these are generally materials of low bearing capacity. They are followed by more elaborate materials and finally the wear layer which is the only layer constructed using a bituminous binder.

Table I below gives one example of a conventional structure made from untreated materials which illustrates the rule of progressive moduli.

TABLE I

| LAYER | THICKNESS | MATERIAL | ELASTIC MODULUS |
|---|---|---|---|
| Wear | 6 cm | Coated | 5 400 MPa |
| Base | 20 cm | 0/20 wetted reconstituted gravel | 360 MPa |
| Foundation | 25 cm | 0/31.5 untreated gravel | 120 MPa |
| Ground | — | Soil | 20 MPa |

Increasing traffic has led to the introduction of structures made from treated materials. These materials are sand or gravel treated either with bitumen or with cement or a similar hydraulic binder.

These structures are designed to operate in bending and are calculated accordingly.

In such cases, the progressive nature of the moduli between the foundation and base layers may still be present, but this is not the general rule, indeed the contrary is the norm.

In practice, a distinction is drawn between:

structures having base and foundation layers with the same rigidity (family F1 from table II below); the two layers are generally made of the same material or similar materials, and structures in which the base layer is significantly less rigid than the foundation layer (family F2 from table II below); in this case the function of the base layer is to prevent upward propagation of transverse shrinkage cracks that inevitably develop in layers of material treated with hydraulic binders.

From the structural point of view, the base and foundation layers are the thickest layers and are responsible for the longevity of the structure. The surface layer is responsible for the comfort and safety of the user.

TABLE II

| Structure type | Semi-rigid | Concrete | Thick bituminous | Mixed | Inverse |
|---|---|---|---|---|---|
| Wear layer | Coated materials | Cement concrete | Coated material | Coated material | Coated material |
| Base layer | MTHB | Concrete cement | Bituminous base course | Bituminous base course | WRG |
| Foundation layer | MTHB | Lean concrete | Bituminous base course | MTHB | MTHB |
| Family | F1 | F1 | F1 | F2 | F2 |

F1: Structures in which $E_{CB} \geqq E_{CF}$
F2: Structures in which $E_{CB} \leqq E_{CF}$
MTHB: Materials treated with hydraulic binders
WRG: Wetted reconstituted gravel Road structures can be damaged by two different processes:

a) as a result of fatigue due to repeated flexing of the most heavily loaded treated layer, generally the foundation layer, and/or b) as a result of permanent deformation resulting from excessive vertical pressure on the untreated materials, in particular the soil.

Designing a road structure to prevent it breaking up therefore entails limiting these loads by increasing the thickness of the component layers of the structure so that they remain below permissible values that depend on the performance of the material and the traffic to which it will be subjected.

SUMMARY OF THE INVENTION

The present invention proposed to substitute a new road structure whose bearing part is made up of a particular three-layer system to replace a conventional prior art two-layer system consisting of a base layer and a foundation layer.

Generally speaking, it comprises two thin outer layers of high performance materials and a median layer of material of more modest performance but which is less costly. Matching a structure of the above kind to the traffic to which it is to be subjected is achieved by increasing the permissible bending moment by increasing the lever arm of the system, i.e. by increasing the thickness of the central layer, which is the one using the least costly material.

Accordingly, the present invention consists in a road structure whose bearing part on top of the ground comprises three successive layers of bituminous materials bonded with each other, namely:

a base layer which rests on the ground with optional insertion of a forming layer of thickness $H_i$ such that:

$$4\text{ cm} \leqq H_i \leqq 10\text{ cm}$$

and of elastic modulus $E_i$ a median layer of thickness Hm such that:

$$4\text{ cm} \leqq H_m \leqq 20\text{ cm}$$

and of elastic modulus $E_m$ such that:

$$2000\text{ MPa} < E_m < 8000\text{ MPa}$$

a top layer of thickness $H_s$ such that:

$$4\text{ cm} \leqq Hs \leqq 10\text{ cm}$$

and of elastic modulus $E_s$,
said elastic moduli of said layers complying with the following inequality relationships:

$$2<E_i/E_m<10 \text{ and } 2<E_s/E_m<10$$

Throughout the description and claims the expression "bituminous materials" is to be interpreted very generally as referring to any type of natural, artificial or recycled road material, in particular sand and/or gravel treated with hydrocarbon binders or possibly hydraulic binders and mixtures of such binders. Examples of bituminous binders are pure or modified bitumen, in the form of bitumen emulsion or blown bitumen or in fluidized form, with or without additives.

All elastic moduli are to be understood as being determined under average operating conditions, i.e. at normal temperatures and traffic speeds.

Other features and advantages of the present invention will become apparent on reading the description given hereinafter referring to the detailed analysis of the behavior of a road structure of the above kind in accordance with the invention.

In accordance with an additional feature of the present invention the top and base layers have elastic moduli that are at least substantially identical and advantageously equal.

In accordance with another feature of the present invention the thickness $H_i$ of the base layer and the thickness $H_s$ of the top layer are at least substantially identical and advantageously equal.

In accordance with a particularly advantageous feature of the present invention the top and base layers of said road structure are of sand and/or gravel treated with a hydrocarbon binder.

Top and base layers of the above kind are preferably constructed from asphaltic concrete having a high modulus, for example a coated material of the type we sell under the trade name BBTHM®, which is a bituminous concrete of very high modulus.

In accordance with another advantageous feature of the present invention the median layer of said structure is constructed from sand and/or gravel treated with a hydrocarbon binder, a hydraulic binder or a mixture of such binders. One example of such binders is the GRAVEMOUSSE® binder we sell.

While it is important to specify that the three successive layers of bituminous materials must be bonded to each other, it should be noted that the adhesion between adjacent layers can be obtained by any means. For example, applying the various layers hot and the particular composition of each layer may procure satisfactory bonding without it being necessary to apply additional layers of other materials.

Bonding between the layers can advantageously be effected by interposing a bonding layer or, if necessary, an impregnation layer and a bonding layer.

The bearing part of the road structure in accordance with the invention includes a base layer that can rest directly on the ground or on a forming layer designed to impart a uniform bearing capacity to the structure. A forming layer of this kind is conventionally constructed from treated or untreated material and can be up to 30 cm thick.

Finally, a road structure of the above kind in accordance with the invention can if necessary be topped with a wear layer the precise nature of which is chosen by the skilled person to suit the traffic to which the road will be subjected. It can be a conventional coated material surface layer approximately 2.5 cm thick, for example.

However, it is important to note that in some particular applications, given the nature and the formulation of the top layer, it is not necessary for the structure in accordance with the invention to be topped by a wear layer.

BRIEF DESCRIPTION OF THE DRAWINGS

These and many other objects and advantages of the present invention will become readily apparent from consideration of the following detailed description of the embodiments of the invention shown in the accompanying drawings wherein.

DETAILED DESCRIPTION OF THE PREFERRED EMBODIMENT

The behavior of a road structure in accordance with the present invention was first analyzed theoretically, by modeling, then by digital calculation.

The model used was a linear elasticity multilayer system subjected to a load corresponding to the 13 T French standard axle (two wheels each of 6.5 T per axle).

The modeling parameters of a three-layer structure on a support of infinite thickness are indicated below.
the top and base layers are thin:

$$H_s=H_i=6\text{ cm}$$

the thickness of the median layer generally varies such that:

$$8\text{ cm} \leqq H_m \leqq 20\text{ cm}$$

modulus contrast:

$$2<E_s/E_m<10$$

$$2<E_i/E_m<10$$

the materials of the top and base layers have similar characteristics. For simplicity it is assumed that the two materials are identical, so that $E_i=E_s$.

The characteristics of this material are those of the high modulus coated product BBTHM® we sell.

Figure 1:
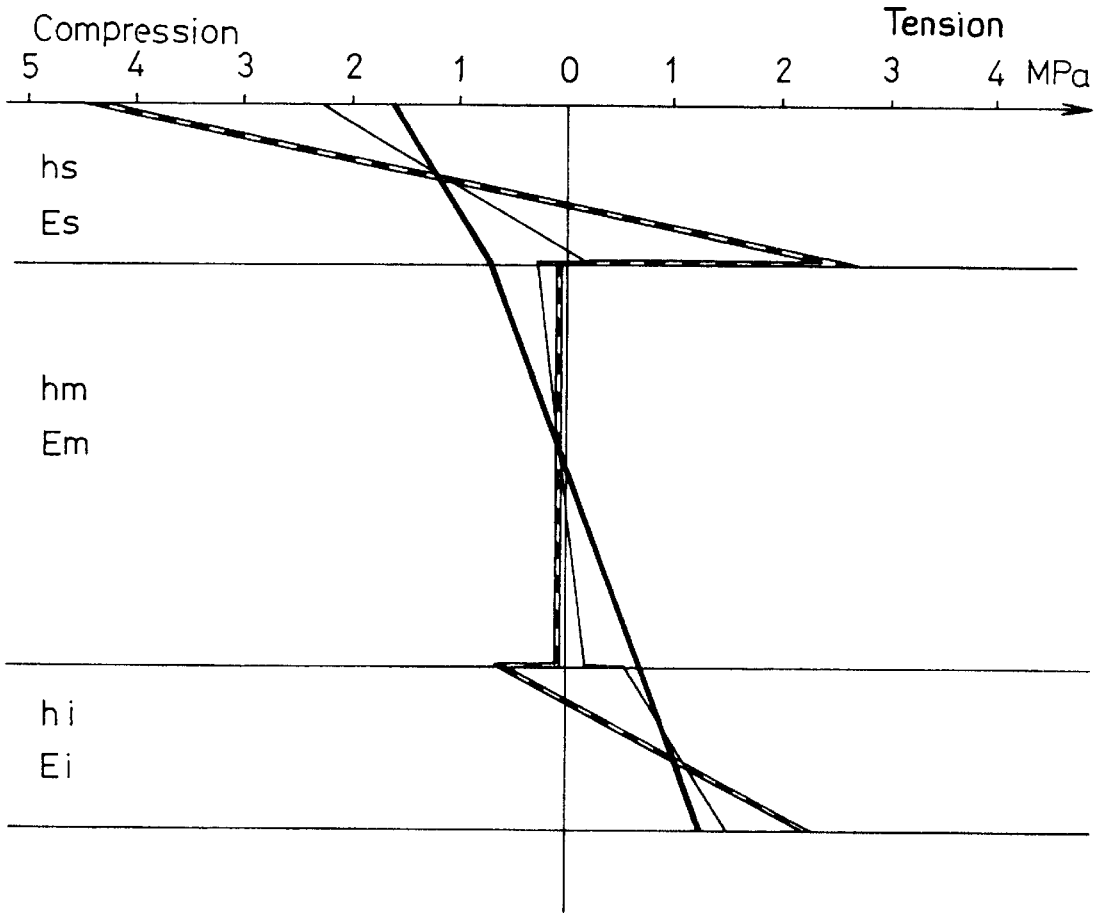
FIG. 1 includes graphs showing diagrams of stresses and deformations along a vertical axis in line with loading in terms of the ratio $E_s/E_m$.

FIG. 1 of the accompanying drawings show that the diagrams of stresses and deformations along a vertical axis in line with the load differ in terms of the ratio $E_s/E_m$.

When the structure is made of the same material ($E_s/E_m=1$) the diagrams are substantially linear. Bending consists in compression at the surface and tension at the bottom.

When the modulus contrast is high ($E_s/E_m=35$), for example with untreated gravel between the two high modulus coated material (BBTHM®) layers, the top and base layers bend independently of each other, the consequences of which are:

high tensile stresses at the base of the top layer and a significant increase in the bending stress at the base of the base layer.

a reduction in the effect of the median layer and in particular the effect of its thickness. Increasing the thickness of this layer does not significantly reduce the tensile stress at the base of the top layer.

Finally, in an intermediate situation ($E_s/E_m=4$), the stress diagram is in the form of broken lines, as previously, but with three fundamental differences:

the disappearance of the tensile stress at the base of the top layer (and therefore of the risk of damage), a slight increase in the tensile stress at the base of the base layer relative to the monolithic structure, preservation of a strong interdependence of the layers, enabling a greater bending moment to be achieved by increasing the thickness of the median layer (the lever arm effect persists).

The decisive value to be examined in a structure of the above kind is the deformation at each interface.

It is used to assess the loading mode (tension or compression) and to determine if there is a critical level at which damage could occur.

Figure 2:
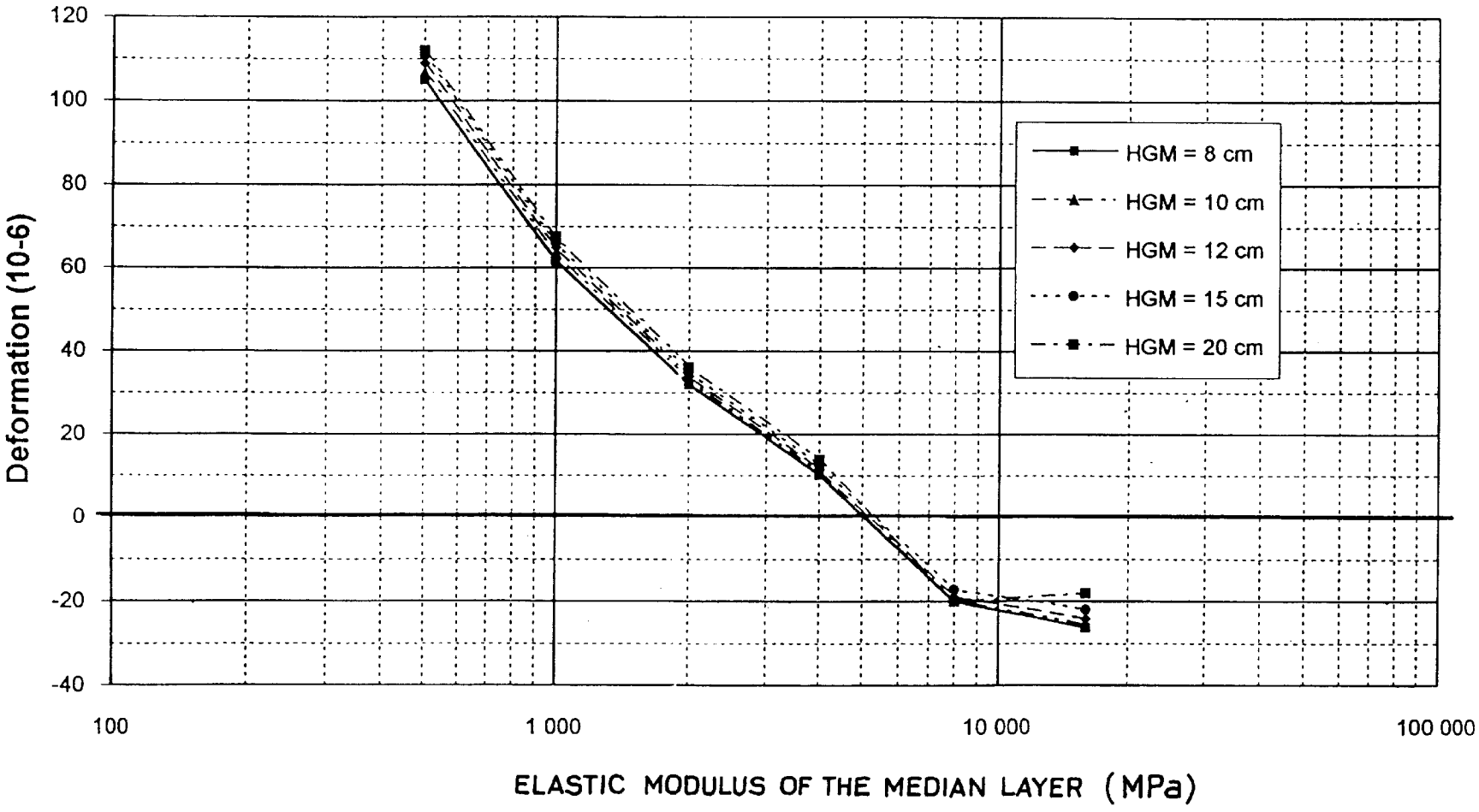
FIGS. 2–4 are graphs showing how the deformation varies as a function of the ratio $E_s/E_m$ and thickness $H_m$.
Figure 3:
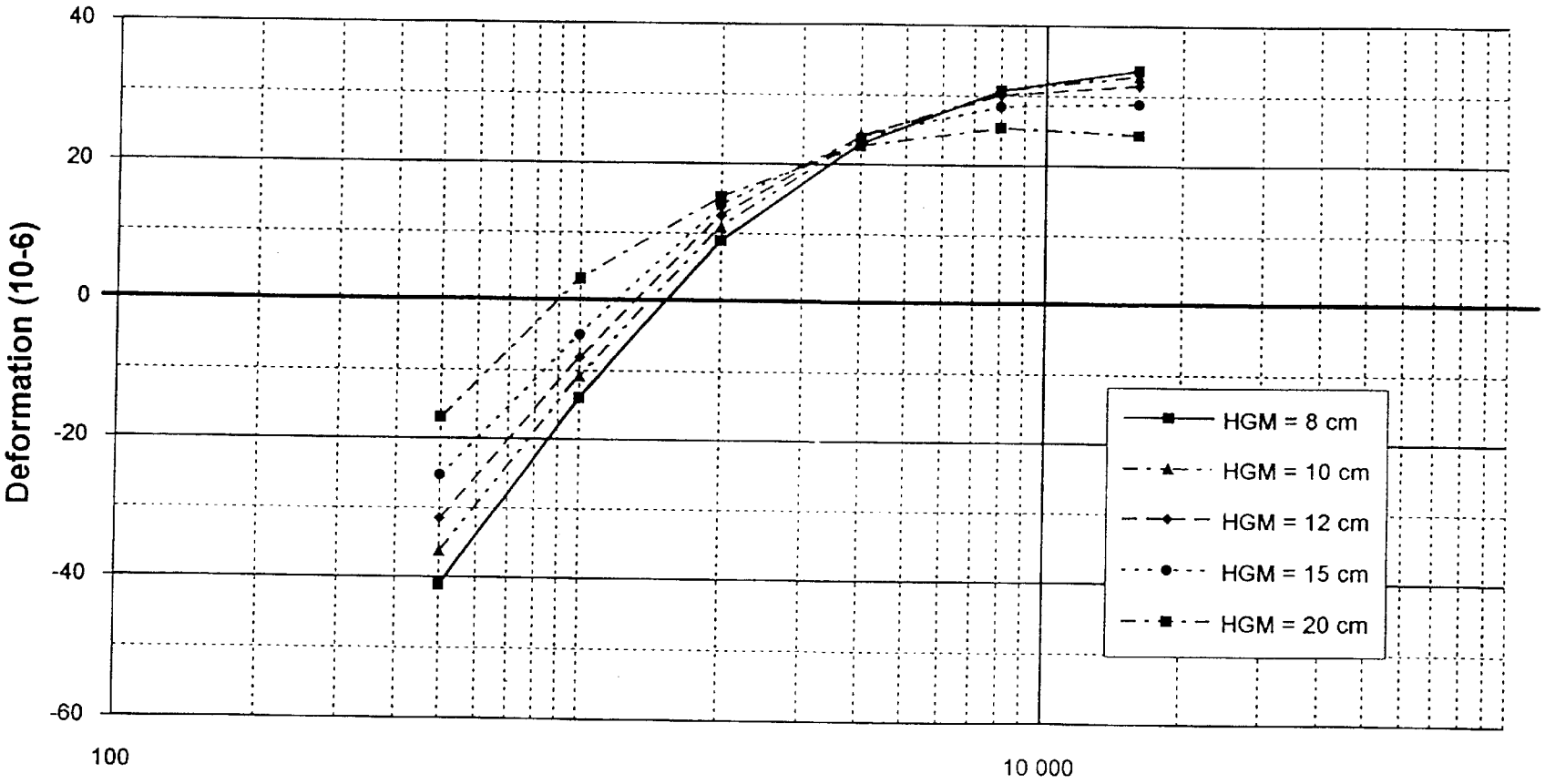
Figure 4:
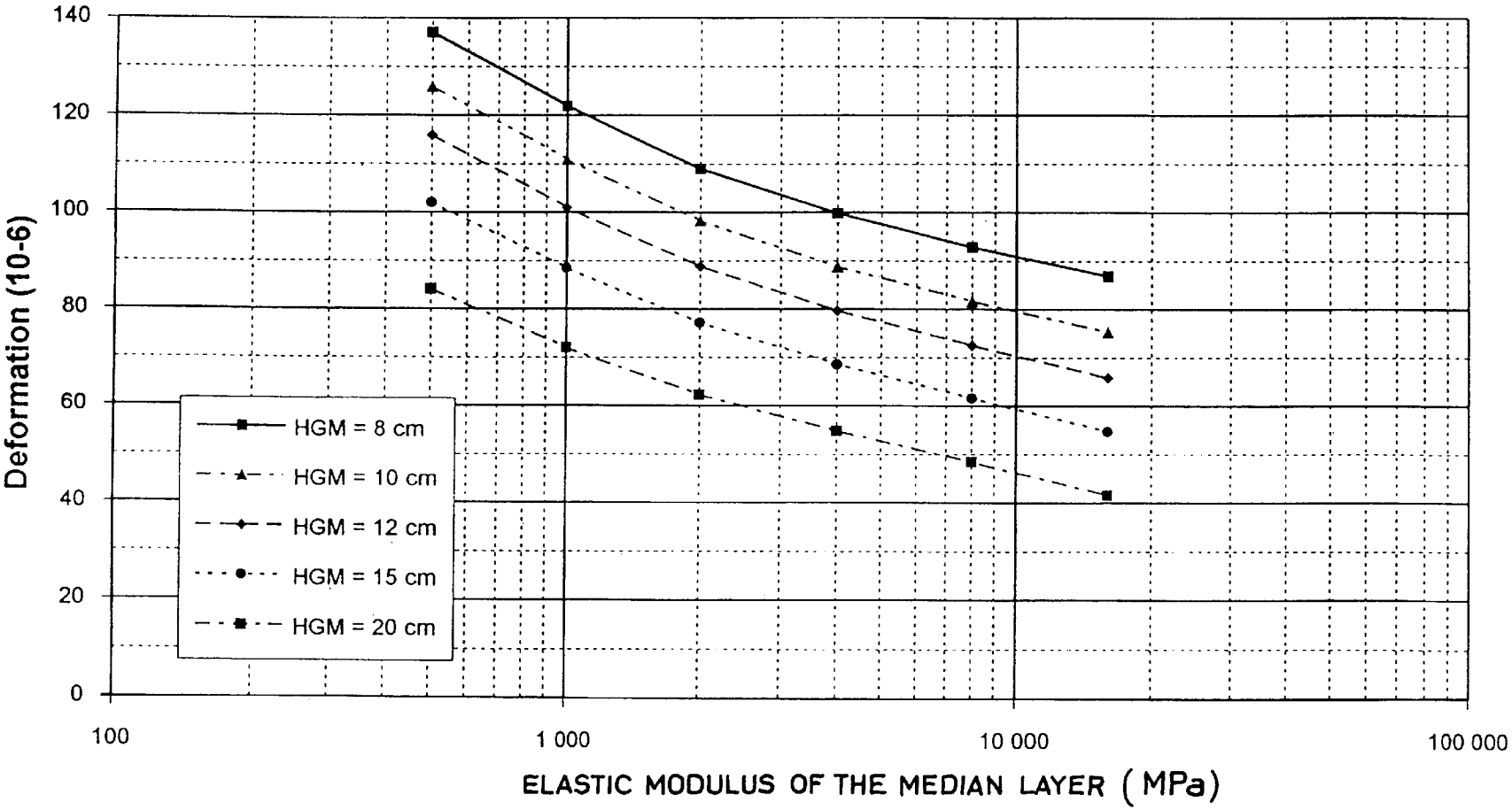

The graphs in FIGS. 2 to 4 of the accompanying drawings show how the deformation varies as a function of the ratio $E_s/E_m$ and the thickness $H_m$.

FIG. 2 shows the deformation at the base of the top layer.

The base of this layer is in tension for high ratios $E_s/E_m$.

For a value of $E_s=500$ MPa (untreated gravel in an inverse structure, for example) the deformation is greater than $100\times10^{-6}$, which makes this a critical design factor.

Furthermore, the thickness $H_m$ of the median layer has little effect on the level of deformation. The only way to reduce this value is to increase the thickness of the top layer. This kind of solution is costly because this is the highest performance material.

For low ratios $E_s/E_m$ the structure behaves like conventional structures, characterized by top layers stressed entirely in compression.

For intermediate ratios $E_s/E_m$, for example for values of $E_m$ in the range 2000 MPa to 5000 MPa, deformation is positive but remains at a sufficiently low level for there to be no risk of damage.

FIG. 3 shows the deformation in the base layer at the level of the top fiber.

This fiber is slightly compressed for low values of $E_m$ (500 MPa to 1500 MPa) and in moderate tension above that value.

FIG. 4 shows the deformation in the base layer at the level of the bottom fiber.

This fiber is in tension regardless of the ratio $E_s/E_m$. The deformation is more sensitive to the thickness of the median layer than its rigidity.

Quadrupling of the modulus $E_m$ (from 5000 MPa to 20000 MPa, for example) can be compensated by increasing the thickness ($H_m$) 2 cm (from 8 cm to 10 cm).

Because the layers are bonded together without risk of slippage, the deformation in the median layer is the same as in the adjacent layers.

The favorable ranges of the modulus $E_m$ that lead to compressive or slight tensile deformation are:

$E_m>2000$ MPa for the top fiber, and $E_m>8000$ MPa for the bottom fiber.

In conclusion, the above analysis shows that the range of interest for the modulus ($E_m$) is the range from 2000 MPa to 8000 MPa and preferably the range from 4000 MPa to 8000 MPa.

Under these conditions:

the top and median layers are subjected to only low tensile stresses and are therefore extremely durable, and the base layer is the most highly stressed layer and its level of deformation can be adjusted to a permissible value depending on the traffic to which it is to be subjected by varying the thickness of the median layer.

The dimensions of the three-layer structure can be determined in the following manner.

Figure 5A:
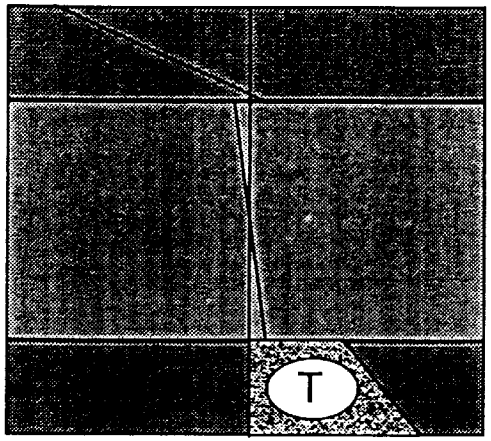
FIGS. 5*a*–5*c* illustrate the three phases involved in the process of the ruination of a structure.
Figure 5B:
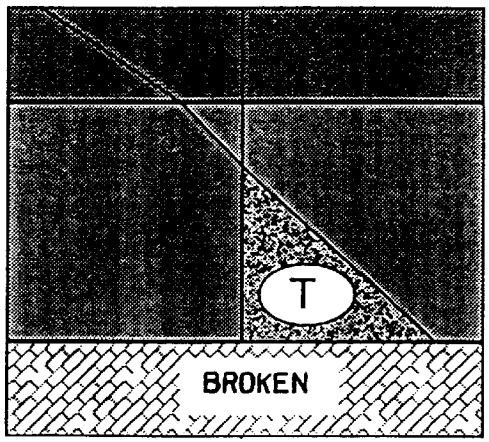
Figure 5C:
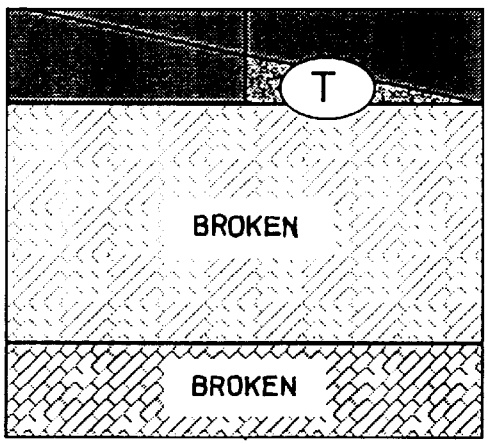

Analyzing the behavior of the three-layer structure enables its rupture mode to be predicted. The process of ruination of a structure of this kind comprises three phases which are illustrated in FIG. 5:

Fatigue of the base layer of the three-layer structure (FIG. 5*a*): during this first phase only the base layer is subject to tensile stress. The number of stresses that the structure can withstand during this phase can be calculated using the usual calculation method (see below).

Fatigue of the median layer (FIG. 5*b*): after the first layer ruptures, the structure operates differently. The median layer is stressed in tension and this mode of operation continues until the median layer ruptures.

Fatigue of the top layer (FIG. 5*c*): after the first two layers rupture, the top layer is subjected to tensile stress and therefore a damage process.

Given the novel mode of operation of this structure, its service life is the sum of three individual service lives.

Figure 6B:
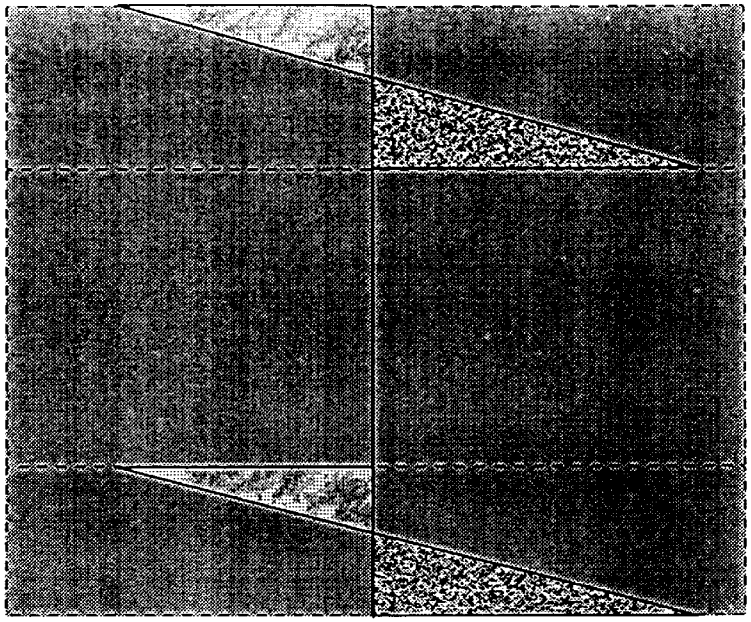
FIGS. 6*a*–6*b* illustrate how a monolithic structure and an inverse structure are damaged.
Figure 6A:
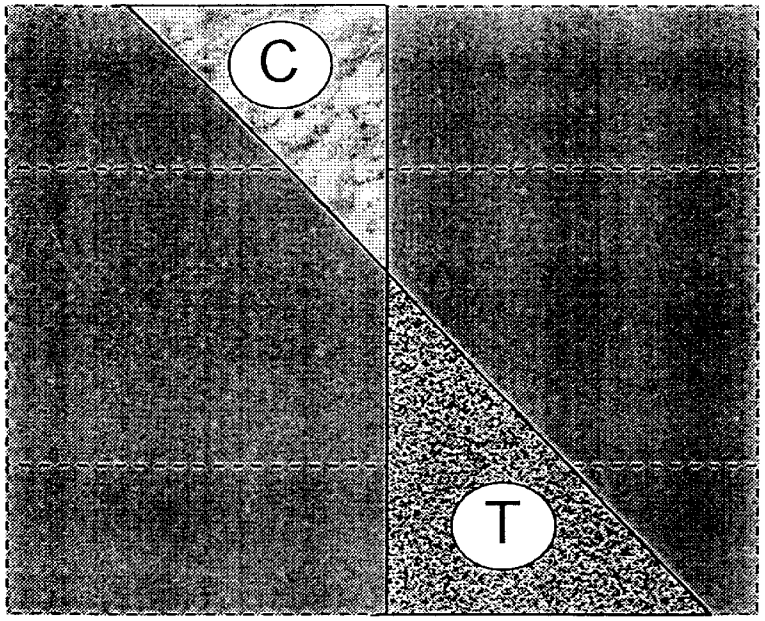

This feature has never been encountered with conventional structures. By way of example, the following two extreme cases can be considered:

a) a structure with the same material as the base and foundation layers (three-layer model with $E_s=E_m=E_i$). In this case the structure is monolithic (see FIG. 6*a*) and the process of ruination comprises only one phase, which consists in damage of the foundation layer. Because the layers are bonded to each other and have at least substantially the same rigidity, any crack appearing at the base of the structure propagates very quickly to the surface. This propagation phase is negligible compared to the onset of cracking phase. In the three-layer structure the presence of a significantly less rigid median layer blocks propagation of the crack and a new onset phase is necessary before the process of ruination can proceed.

b) An inverse structure (three-layer model with $E_m \leqq E_i$ and $E_s$). In this situation the top and base layers are damaged simultaneously (see FIG. 6*b*) and there is no effect of addition of the service lives of the layers.

To illustrate the improved service life of the three-layer structure in accordance with the invention, the calculation proposed to illustrate the approach was applied to the following structure on a PF2 platform:

6 cm of BBTHM®+8 cm of GM+6 cm of BBTHM® where GM is gravel treated with blown bitumen, in particular Grave-Mousse®.

Table III below shows the modeling of the three phases:

TABLE III

| Layer | 1st phase | 2nd phase | 3rd phase |
|---|---|---|---|
| Top | 17 800 | 17 800 | 17 800 |
| Median | 5 500 | 5 500 | 1 100* |
| Bottom | 17 800 | 3 500* | 3 500* |

Moduli of the layers (in MPa) as a function of their condition (intact or broken*).

The calculated critical deformations are:

$1^{st}$ phase: $85.5\times10^{-6}$ at the base of the base layer, $2^{nd}$ phase: $112\times10^{-6}$ at the base of the median layer, $3^{rd}$ phase: $87.6\times10^{-6}$ at the base of the top layer.

The fatigue characteristics required for the calculation are set out in table IV below:

TABLE IV

| | $e_6$ | Slope | SN | SH |
|---|---|---|---|---|
| BBTHM ® | $132 \times 10^{-6}$ | 0.175 | 0.29 | 1 cm |
| Grave-Mousse ® | $109 \times 10^{-6}$ | 0.126 | 0.6 | 1 cm |

The service life of each layer was calculated using the following equation, in accordance with France's technical guide to the design and dimensioning of road structures: where $$\varepsilon_t - \varepsilon_6\left(\frac{N}{10^6}\right)^b \cdot K_c \cdot K_r \cdot K_s$$

$\epsilon_t$ is the deformation at the base of the bituminous layers $\epsilon_6$ is the deformation that leads to a service life equivalent to $10^6$ cycles N is the number of cycles $K_c$ is the locking coefficient $K_c$=1 for BBTHM®

$K_c$=1.3 for Grave-Mousse®

$K_r$ is a coefficient which adjusts the permissible deformation value to the calculation risk adopted in accordance with the spreading factors for the thickness (standard deviation Sh) and the fatigue test results (standard deviation SN)

$$K_r=10^{-ub\delta}$$

u is a reduced centered variable associated with the risk r b is the slope of the fatigue law of the material (bilogarithmic law)

δ is the standard deviation of the logN distribution at rupture $$\delta=[SN2+(c^2/b^2)Sh^2]^{0.5}$$

c is a coefficient relating the variation in deformation to the random variation in the thickness of the road $$\Delta h_1(\log \epsilon - \log \epsilon_0 - c\Delta h)$$

For standard structures, c is in the order of 0.02 $cm^{-1}$.

$K_s$ is the platform coefficient. Here its value is 1.

The following calculations assume U=2.05 which corresponds to a rupture risk of 2% (this is the risk figure usually adopted for heavy traffic roads).

Figure 7:
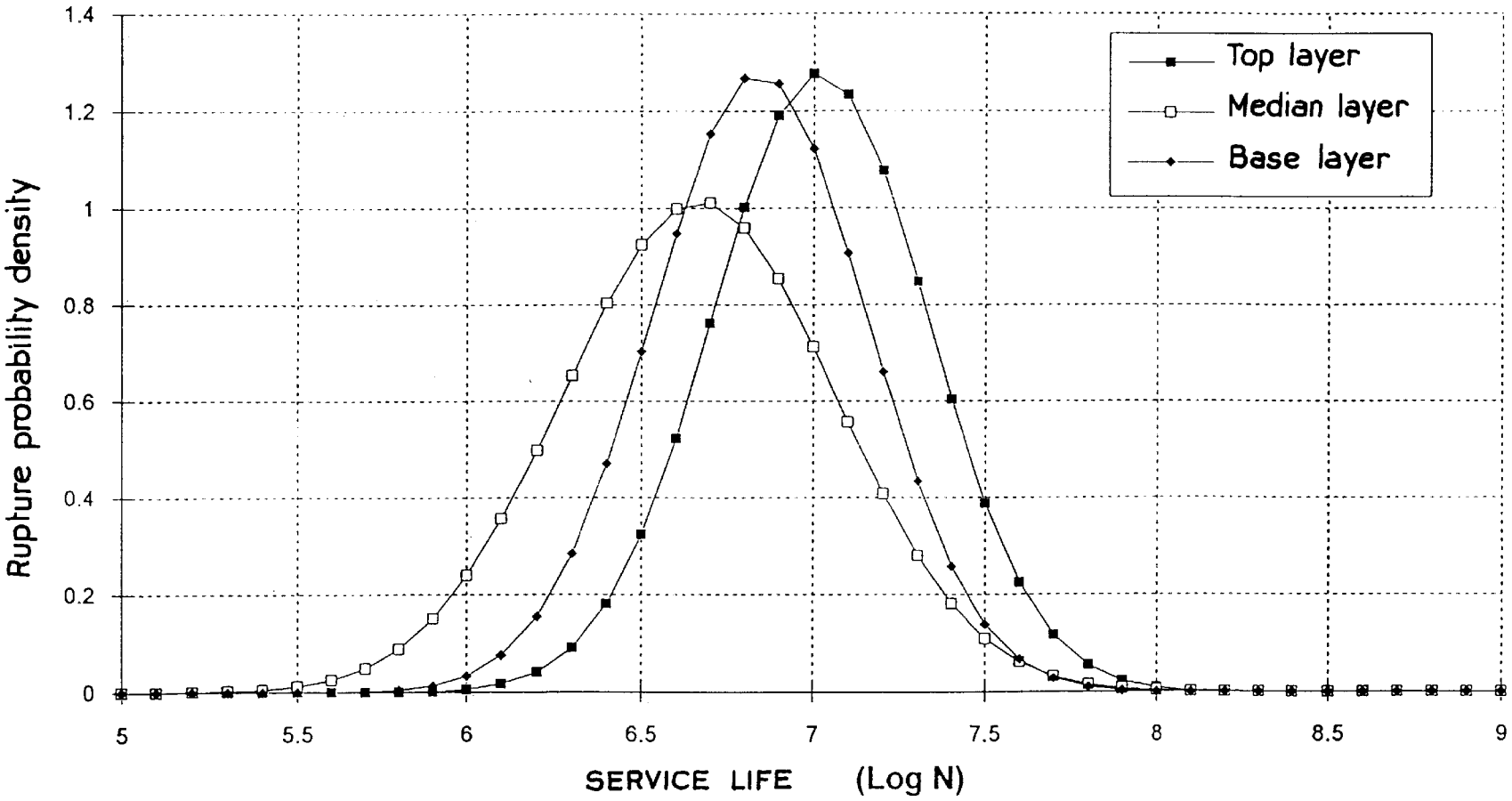
FIGS. 7–8 are graphs showing the rupture probability density based on the service life of a three-layer structure.

In order to calculate the service life of the three-layer structure, the rupture probability density was calculated for each of three layers shown in FIG. 7 of the accompanying drawings.

Figure 8:
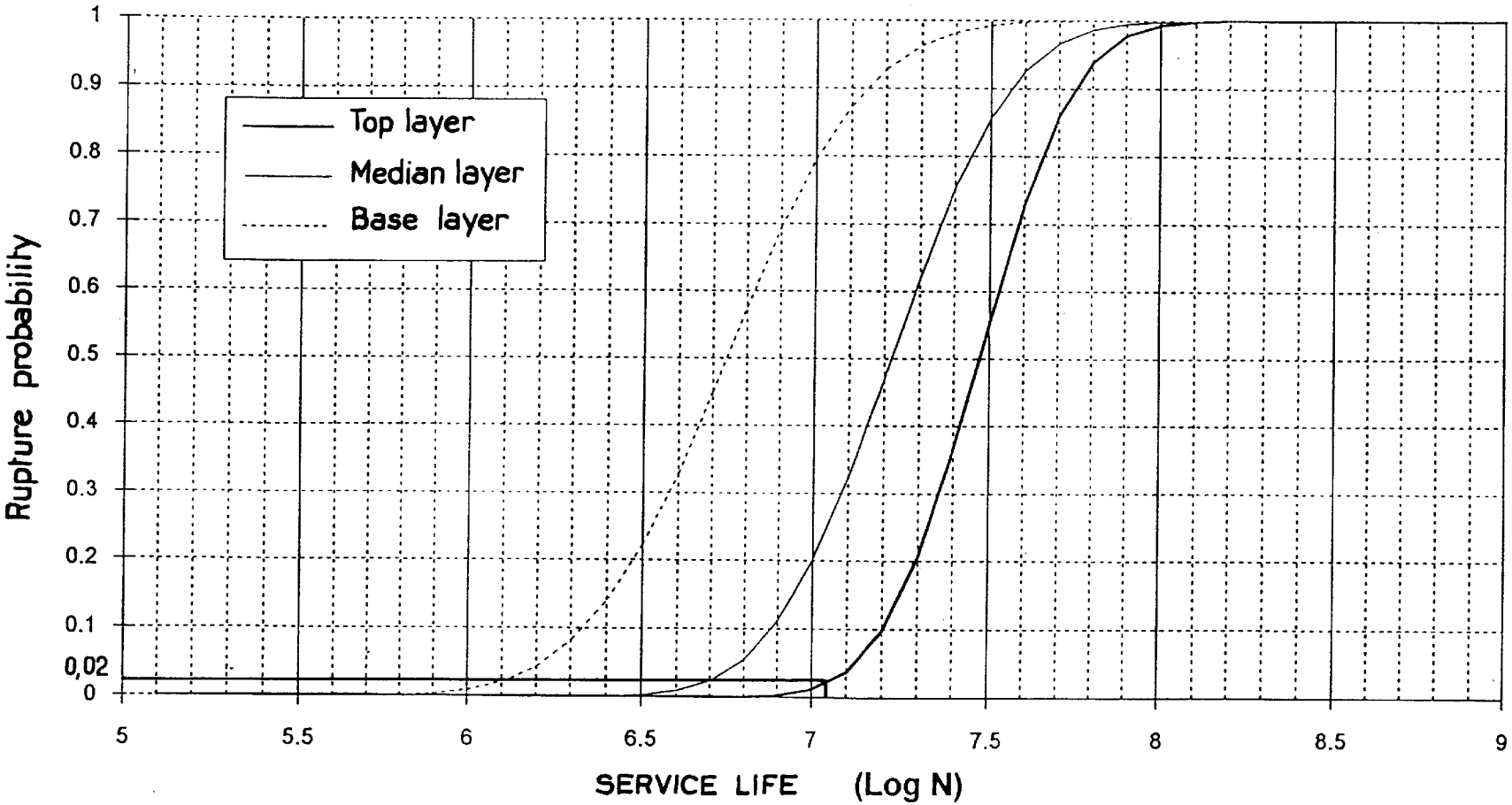

FIG. 8 of the accompanying drawings shows the rupture probability of the three-layer structure, which is the product of the rupture probability of each layer.

Note that for a 2% rupture risk the predicted service life is such that:

| | | |
|---|---|---|
| log(N) | = | 7.04 |
| i.e. N | = | $11 \times 10^6$ |

The thickness of a monolithic structure (consisting entirely of BBTHM®) of equivalent service life is 25 cm, or 38 cm for a conventional bituminous base course structure, compared to 20 cm for the three-layer structure.

The mechanical performance of the three-layer structure in accordance with the invention enables significant savings in materials. Table V below sets out a materials balance for three equivalent structures in terms of service life constructed on identical supports:

The first is a three-layer structure 20 cm thick (6 cm of BBTHM®+8 cm of Grave-Mousse®+6 cm of BBTHM®).

The second is a monolithic structure consisting of 25 cm of BBTHM®. Note that this type material is at present that offering the highest performance enabling the use of the thinnest structures.

The third is also a monolithic structure, comprising 38 cm of class 2 bituminous base course (GB2).

TABLE V

| | | 3-layer | BBTHM | GB2 |
|---|---|---|---|---|
| BBTHM ® or BG2 | Thickness (cm) | 2 × 6 | 25 | 38 |
| | Weight ($kg/m^2$): | | | |
| | aggregates | 284 | 591 | 816 |
| | bitumen | 16 | 34 | 34 |
| | TOTAL | 300 | 625 | 850 |
| Grave-Mousse ® | Thickness (cm) | 8 | — | — |
| | Weight ($kg/m^2$): | | | |
| | aggregates | 170 | — | — |
| | bitumen | 6 | — | — |
| | TOTAL | 176 | — | — |
| Total | Thickness (cm) | 20 | +25% | +90% |
| | Weight ($kg/m^2$): | | | |
| | aggregates | 454 | +30% | +80% |
| | bitumen | 22 | +55% | +55% |
| | TOTAL | 476 | +31% | +79% |

The above materials balance shows up the following advantages compared to the highest performing conventional structure:

a very significant saving in the most costly material, i.e. more than half the bitumen;

a saving in aggregates (30%), which also generates savings in transport and application;

a reduction in thickness which in built-up areas leads 10 to savings in earthmoving works.

An example of the three-layer structure was tested on the fatigue test bed of the Nantes Laboratoire Central des Ponts et Chaussées (LCPC) to define its real mode of operation and verify its fatigue strength.

Figure 9:
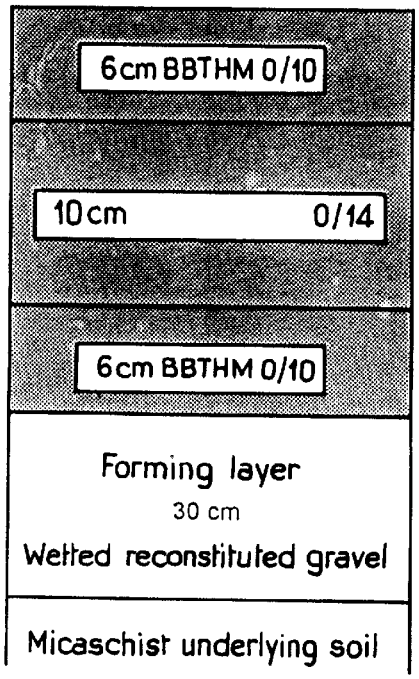
FIG. 9 illustrates a road structure constructed with conventional materials and typical roadmaking techniques.

The road structure shown in FIG. 9 was constructed with the conventional materials and the usual roadmaking techniques. In this sense, the test results are highly representative of the technique to be assessed.

In addition to the wetted reconstituted gravel (WRG) used in the forming layer, the three-layer structure included two types of material.

a) BBTHM

This is a 0/10 particle size range coated material of high modulus containing 90% ground aggregates from solid rock and 10% rolled natural sand. The binder was 10/20 grade hard bitumen in an amount of 5.8 ppc.

The coated material confirmed to French standard NPF 98 128 defining high modulus coated materials (Class 2 EME). The main mechanical characteristics of the coated material were:

complex modulus at 15° C. and 10 Hz:

$$|E^*|=17800 \text{ MPa}$$

fatigue strength (imposed deformation test) permitted deformation at $10^6$ cycles $$(15° \text{ C.-10 Hz}): \epsilon_6=132\times10^6)$$

slope of fatigue line: b=−0.175 b) Grave-Mousse®

Grave-Mousse® is a bedding material prepared by incorporating hot blown bitumen into cold aggregates. The particle size range is that of wetted reconstituted gravel (WRG) with a full curve that has good short term stability characteristics. The formulation used, with a particle size range of 0/10, was composed entirely of crushed aggregates from solid rock. The bitumen content was 3.5 ppc. The bitumen was chosen for its blowing qualities and its 70/100 grade average hardness. The main mechanical characteristics of this material were:

complex modulus at 15° C. and 10 Hz:

$$|E^*|=5500 \text{ MPa}$$

fatigue strength (15° C. and 10 Hz)

$$\epsilon_6=109\times10^{-6})$$

slope of fatigue line: b=−0.126

Figure 10:
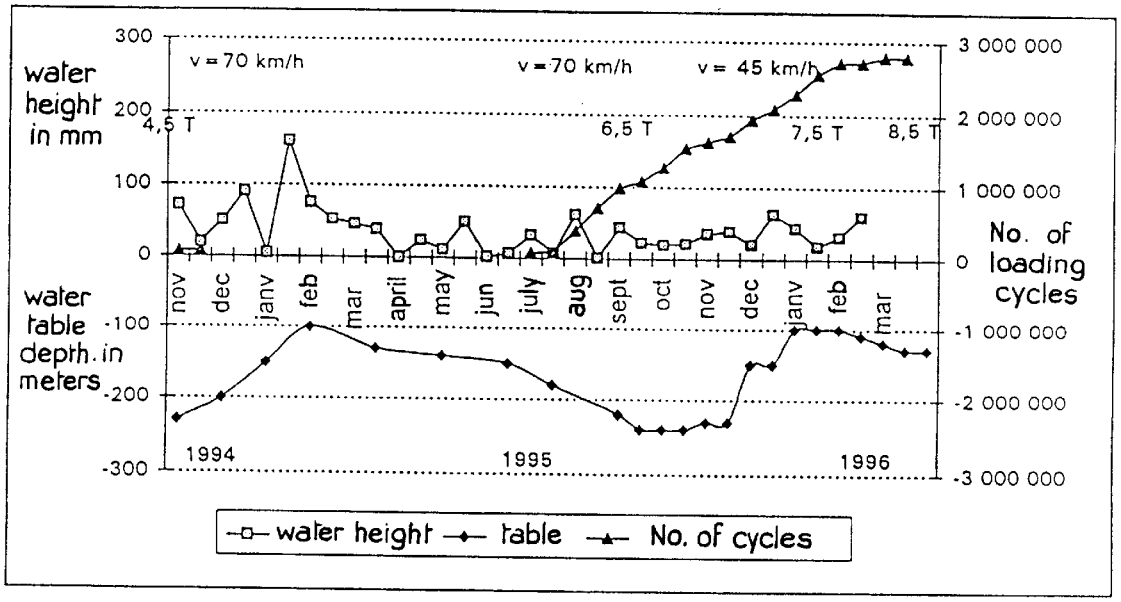
FIG. 10 is a graph showing fatigue tests conducted in four phases with progressively increasing loads.

Conduct of the fatigue test:

The fatigue test was carried out in four phases with progressively increasing loads (FIG. 10):

The first phase was a pre-loading phase with the aim of recreating the usual conditions of maturing of the materials and in particular of the Grave-Mousse®, which would seem to be accelerated by the effect of traffic. This phase, carried out during November 1994, involved approximately 70000 passes of a twin-wheel loaded to 4.5 T.

The second phase, which constituted the major part of the fatigue test, began in August 1995 after completion of experiments in progress on two other test beds. The intended number of passes for this phase was 1.5 million. In fact it comprised 2.1 million passes of a twin-wheel loaded to 6.5 T, corresponding to the French 13 T reference axle. The second phase was completed in November 1995.

The third phase, which was extended by the fourth phase, was intended to assess the limiting strength of the new structure which showed no external signs of fatigue in the previous stage. During these two phases the twin-wheel was loaded to 7.5 T for 100000 passes and then to 8.5 T (standard 17 T overladen axis) for 500000 further passes.

The test was stopped after the structures had undergone the equivalent of 4.7 million passes of a 13 T axle.

Figure 11:
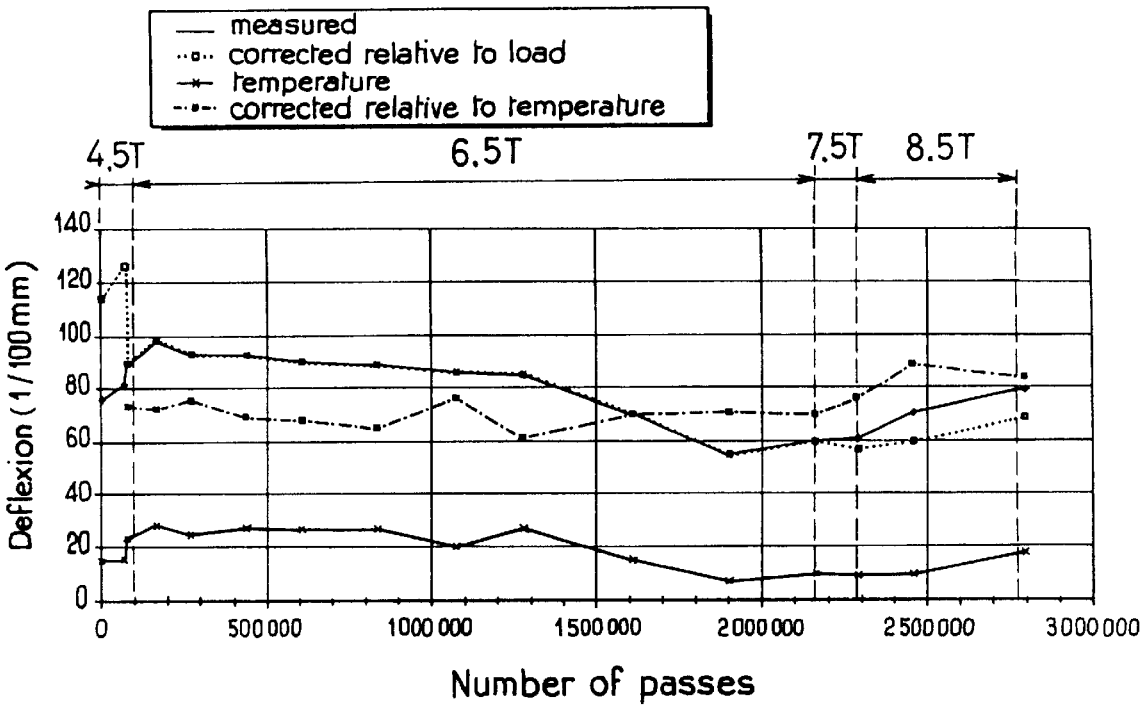
FIG. 11 is a graph showing the deflection of the surface during fatigue testing.
Figure 12:
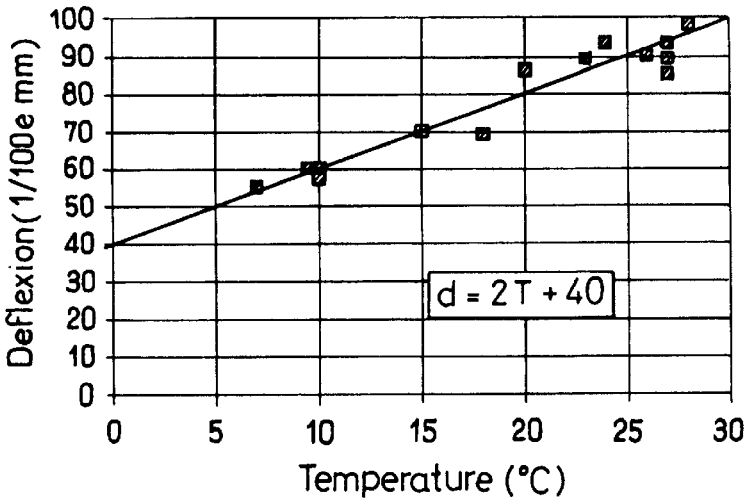
FIG. 12 is a graph showing the correlation between deflection of the surface and temperature during fatigue testing.

Water table and temperature conditions changed over the test period. They are shown in FIG. 11 (water table layer) and FIG. 12 (temperatures in the structure).

The number of equivalent axles Neq was determined as follows:

$$Neq = \sum n_i \left[\frac{P_i}{6.5}\right]^{-1/b}$$

Throughout the fatigue test the structure was checked by surface measurements (deflection, rutting depth, visual inspection) and within the body of the structure (strain gauges, ovalization).

FIG. 11 shows the deflection measurements. They were taken under the twin-wheel in use at the time of the test, the weight of which varied from 4.5 T at the beginning of the test to 8.5 T at the end.

These raw values were subject to a correction proportional to the load in order to refer them to the French 6.5 T standard axle.

The first two values were measured with a load of 4.5 T before application of the second BBTHM® layer.

The graph clearly shows that the deflection varied with the temperature measured in the structure.

Detailed analysis of the phenomenon showed that the variation was linear (FIG. 12) and that a variation in temperature of 1° C. corresponded to a variation in deflection of 2/100 mm.

Corrected for variations in load and temperature, the deflection did not change significantly except at the end of the experiment, where the slight increase noted may have been due to the high level of the water table. These observations lead us to think that the structure was not damaged during the fatigue test.

A transverse profile measuring device was used to measure the rut depth or rutting in the rolling strip.

Figure 13:
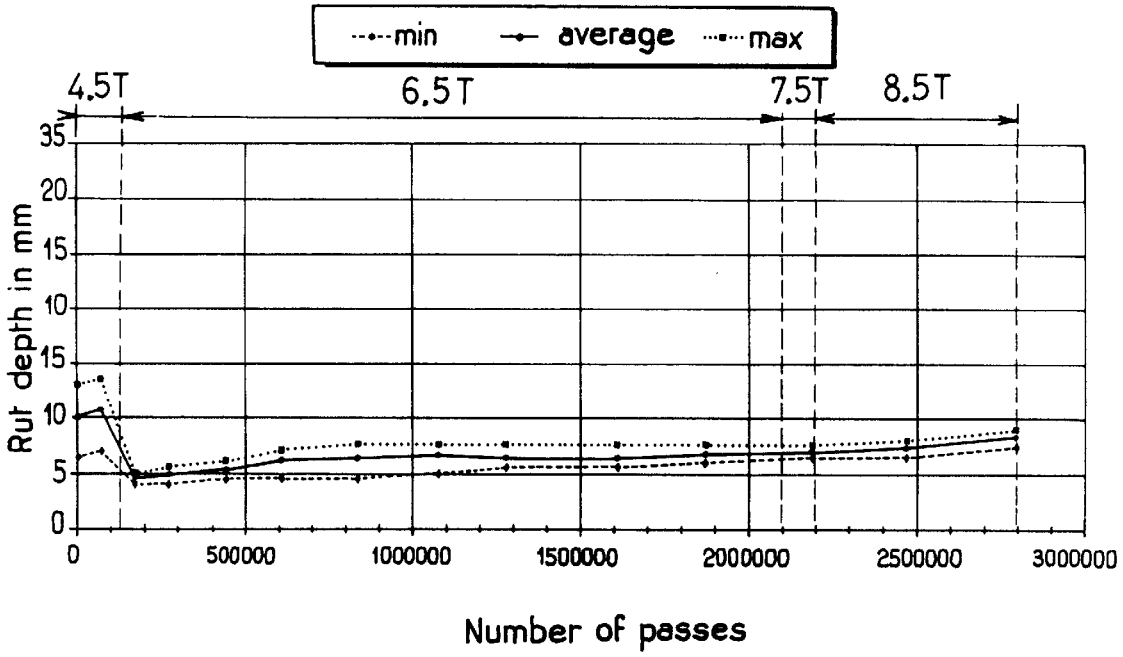
FIG. 13 is a graph showing the depth of rut depending on the load applied.

FIG. 13 is a graph showing how these parameters changed with the load.

The initial rutting after application of the third layer was 5 mm; it corresponded more to a defective transverse profile produced during compacting than to evolution under traffic. Rutting then increased linearly with the number of loading cycles, but very slowly: 1 mm per million passes with the 6.5 T axle.

The rutting behavior of the structure was therefore highly satisfactory, from the point of view of both creep of the bituminous layers and the level of permanent deformation of the underlying ground, which the structure protected effectively.

No surface deterioration was seen during the experiment.

The ovalization test measured the deformation of a core sample drilling hole when the load passed over it. The results were processed to determine the deformation in the structure before core sample drilling, and therefore in normal operation.

Two tests were carried out, one in the rolling strip where there was the possibility of fatigue damage (1.645 million passes) and the other outside the strip. The latter test was representative of the behavior of the structure prior to any damage.

Figure 14:
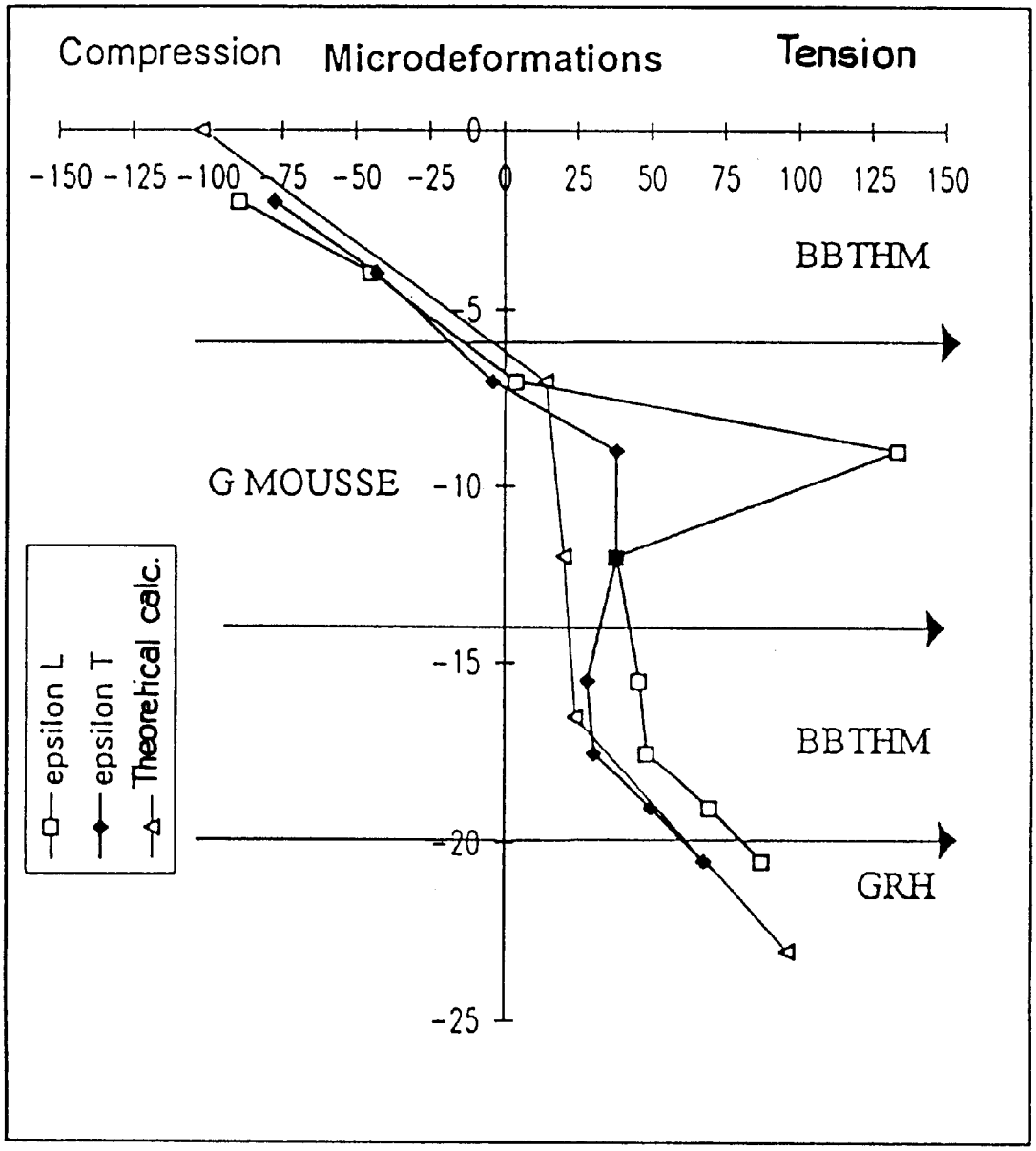
FIG. 14 is a diagram indicating deformation in undamaged structure.

The diagram indicating the deformation determined in this way for the undamaged structure (FIG. 14) shows relatively continuous profiles agreeing with that calculated using the digital model.

Figure 15:
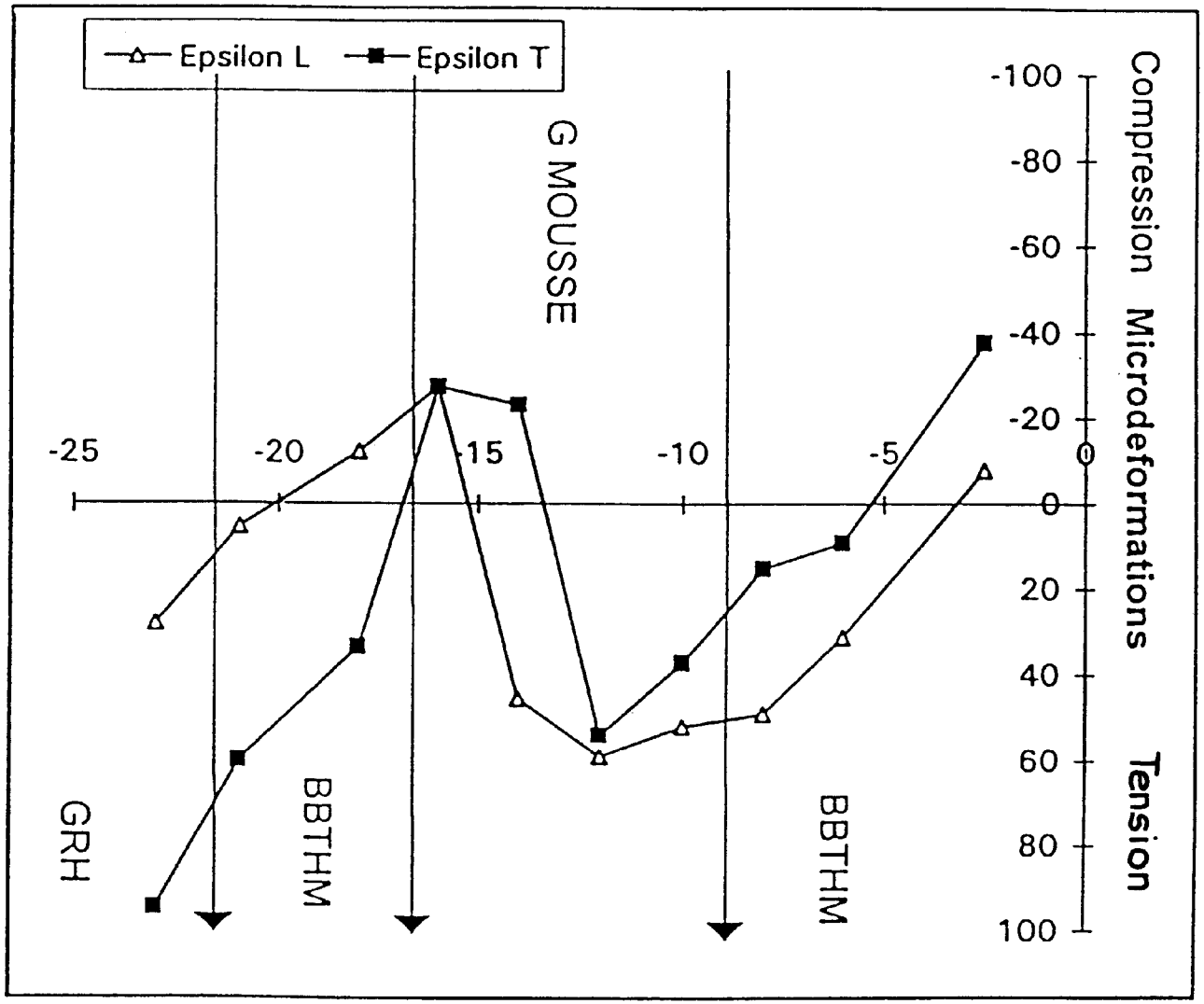
FIG. 15 is a diagram indicating deformation in a traffic area.

The diagrams obtained during the test in a traffic area (FIG. 15) show a sudden variation in the lower half of the median layer. This type of profile suggests a slip plane at this level (the structure was subsequently sectioned and this confirmed the hypothesis).

Figure 16:
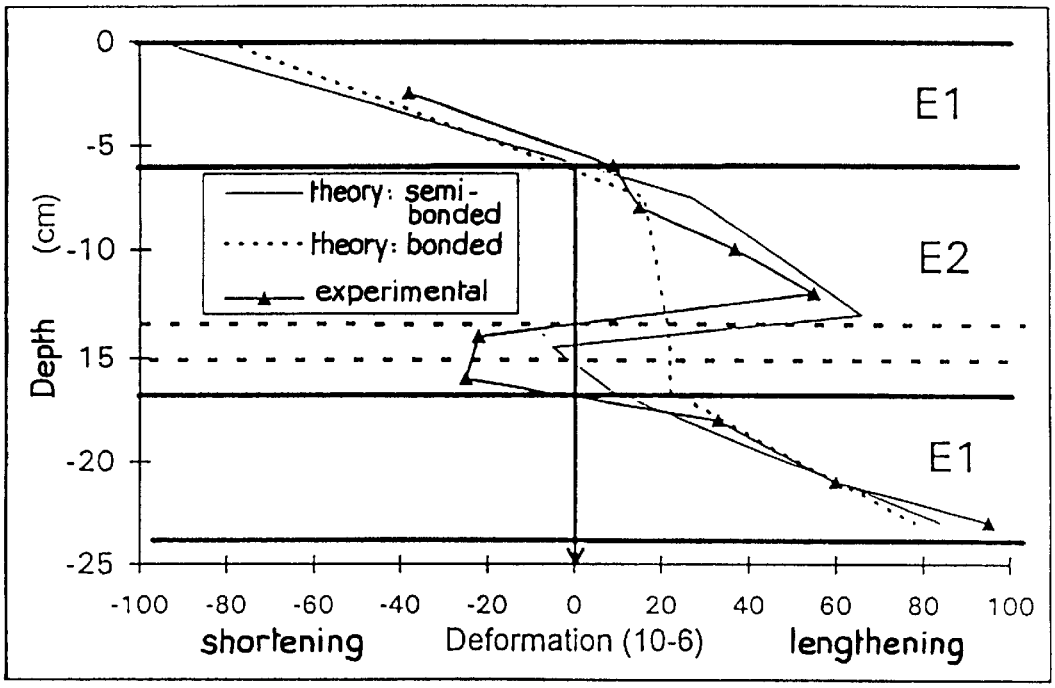
FIG. 16 is a graph showing adjustments made to a layer based on a model.

Modeling this phenomenon using a simple sliding interface yielded excessively high deformation figures. Good agreement was obtained by modeling the degraded area using a thin (1.5 cm) layer of low rigidity (500 MPa). This figure corresponded substantially to that for untreated gravel. FIG. 16 shows the adjustments obtained in this way.

Core samples were taken and sections were carried out during destructive testing of the structure at the end of phase 2.

The core samples confirmed the presence of a rupture surface at the bottom of the median layer in line with the rolling strip. In contrast, the core samples outside the rolling strip were intact.

The sections confirmed the diagnosis. They enabled the rupture surface to be seen and showed that it was limited to the rolling strip.

This indicated fatigue rupture of the Grave-Mousse® rather than a pre-existing defect.

The rupture surface was horizontal and therefore not the result of fatigue in bending, which would have caused vertical cracking. It would seem to be the consequence of fatigue in shear. Calculating the shear stress in the median layer confirmed this hypothesis.

Figure 17:
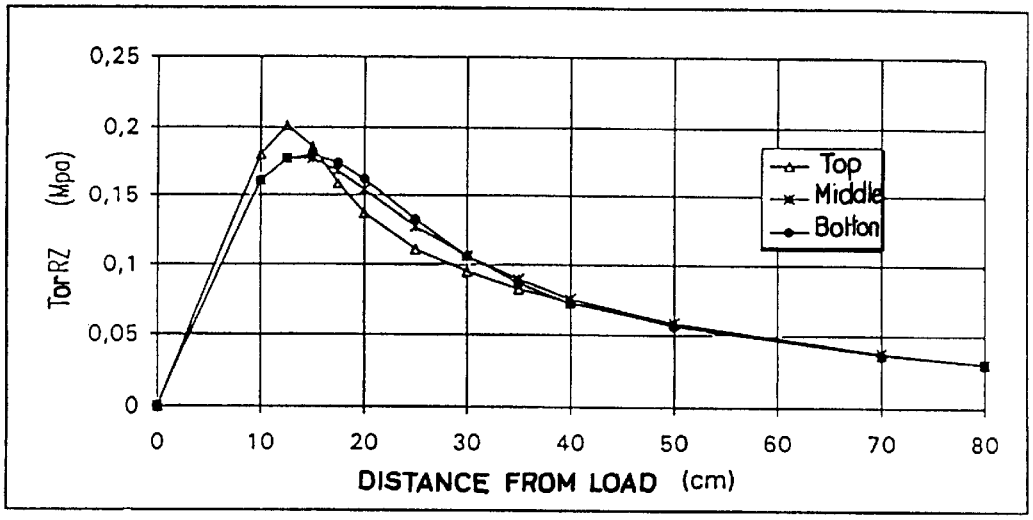
FIG. 17 is a graph showing sheer stress due to loading of a twin-wheel.

The FIG. 17 graphs show that the sheer stress under the twin-wheel reached 0.2 MPa. This corresponds to a deformation in the order of $70\times10^{-6}$ (for a modulus of 4000 MPa and a Poisson's coefficient of 0.35), which is entirely significant for this material whose permissible value for one million cycles is:

$$\epsilon_6=109\times10^{-6}$$

What is more, the maximum value was relatively constant throughout the thickness of the median layer, although the vertical stress decreased strongly with depth, which encourages the expansion of the crack plane at the bottom of this layer.

Figure 18:
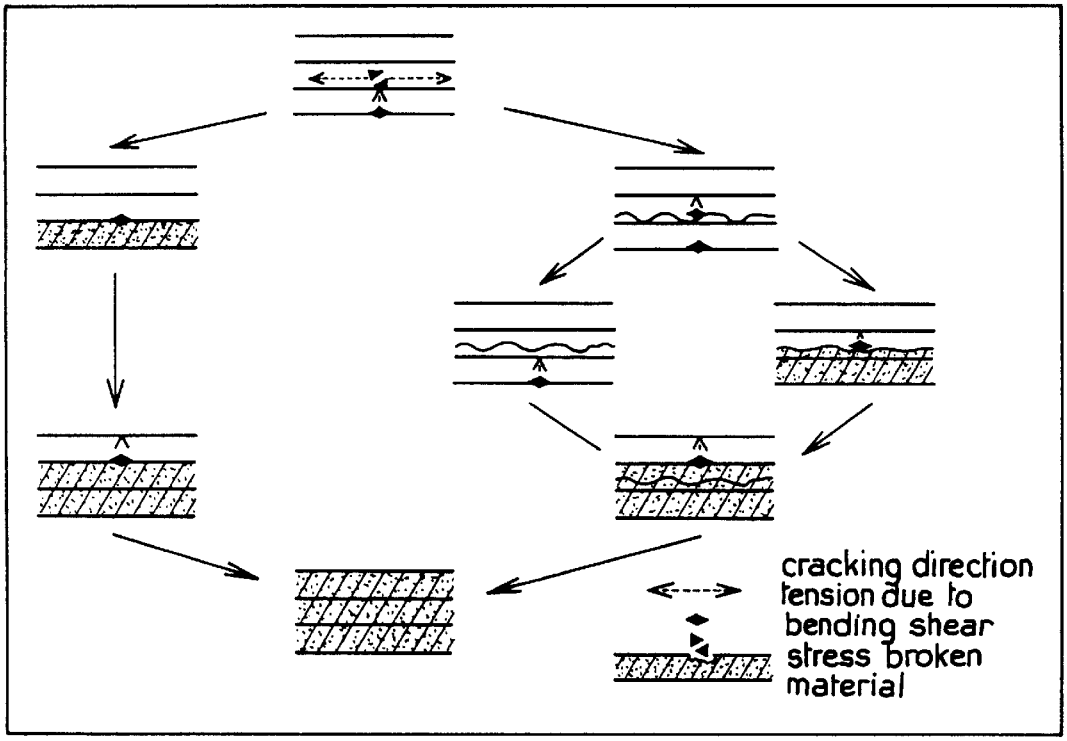
FIG. 18 are diagrams illustrating one possible process mode of rupture of a three-layer structure.

The three-layer structure had an unusual rupture mode that differed from the rupture mode previously described. It was one possible mode of a more general process shown in FIG. 18.

In conclusion, the experiments showed that it is possible to minimize the cost of a road structure by a judicious choice of materials in accordance with their mechanical characteristics.

The theoretical approach can define the ratio of the moduli of the materials so that the behavior of the structure is optimal ($E_s=E_i$ and $10>E_s/E_m>2$).

The experiments on the Nantes LCPC fatigue test bed verified the behavior of a structure of the above kind constructed to a real life scale using the usual methods. The behavior of the structure was found to conform to the predictions drawn from the model and led to excellent traffic resistance.

At the end of the experiments the test bed showed no signs of deterioration despite 2.7 M passes of which 600000 were overladen in terms of the French legal maximum axle load. The total traffic equivalent corresponded to approximately five million 13 T axles.

What is claimed is:

1. A road structure whose bearing part on top of the ground comprises three successive layers of bituminous materials bonded with one another, namely:

a base layer which rests on the ground and which has a thickness $H_i$ such that:

$$4\text{ cm}\leqq H_i\leqq 10\text{ cm}$$

and of elastic modulus $E_i$ a median layer of thickness $H_m$ such that:

$$4\text{ cm}\leqq H_m\leqq 20\text{ cm}$$

and of elastic modulus $E_m$ such that:

$$2000\text{ MPa}<E_m<8000\text{ MPa}$$

a top layer of thickness $H_s$ such that:

$$4\text{ cm}\geqq H_s\leqq 10\text{ cm}$$

and of elastic modulus $E_s$, said elastic moduli of said layers complying with the following inequality relationships:

$$2<E_i/E_m<10 \text{ and } 2<E_s/E_m<10.$$

2. A road structure according to claim 1, characterized in that the base and top layers have at least substantially identical elastic moduli.

3. A road structure according to claim 2, characterized in that the base and top layers have identical elastic moduli.

4. A road structure according to claim 1, characterized in that the thicknesses of the base and top layers $H_i$ and $H_s$ are at least substantially identical.

5. A road structure according to claim 4, characterized in that the thicknesses of the base and top layers $H_i$ and $H_s$ are equal.

6. A road structure according to claim 1, characterized in that said base and top layers are constructed of sand and/or gravel treated with a hydrocarbon binder.

7. A road structure according to claim 6, characterized that the base and top layers are constructed from high modulus asphaltic concrete.

8. A road structure according to any one of claims 1 to 7, characterized in that the median layer is of sand and/or gravel treated with a hydrocarbon binder, a hydraulic binder or a mixture of such binders.

9. A road structure according to claim 1, characterized in that said layers are bonded to each other by interposing a bonding layer or an impregnation layer and a bonding layer.

10. A road structure according claim 1, characterized in that said structure is topped with a wear layer.

11. A road structure whose bearing part on top of the ground comprises three successive layers of bituminous materials bonded with one another, namely:

a forming layer which rests on the ground, a base layer which rests on said forming layer and which has a thickness $H_i$ such that:

$$4\text{ cm}\leqq H_i\leqq 10\text{ cm}$$

and of elastic modulus $E_i$;

a median layer of thickness $H_m$ such that:

$$4\text{ cm}\leqq H_m<20\text{ cm}$$

and of clastic modulus $E_m$ such that:

$$2000\text{ MPa}<E_m<8000\text{ MPa}$$

a top layer of thickness $H_s$ such that:

$$4\text{ cm}\leqq H_s\leqq 10\text{ cm}$$

and of elastic modulus $E_s$, said elastic moduli of said layers complying with the following inequality relationships:

$$2<E_i/E_m<10 \text{ and } 2<E_s/E_m<10.$$

* * * * *

UNITED STATES PATENT AND TRADEMARK OFFICE

CERTIFICATE OF CORRECTION

PATENT NO. : 6,089,783
DATED : July 18, 2000
INVENTOR(S) : Honoré Goacolou

It is certified that error appears in the above-identified patent and that said Letters Patent is hereby corrected as shown below:

Claim 1,
Line 13, the formula should be as follows:

$$4 \text{ cm} \leq H_s \leq 10 \text{ cm}$$

Signed and Sealed this

Twentieth Day of November, 2001

*Attest:*

Nicholas P. Godici

NICHOLAS P. GODICI
*Acting Director of the United States Patent and Trademark Office*

*Attesting Officer*